US007080495B2

(12) United States Patent
Suolahti

(10) Patent No.: US 7,080,495 B2
(45) Date of Patent: Jul. 25, 2006

(54) WRAPPING APPARATUS

(75) Inventor: Yrjo Suolahti, Masku (FI)

(73) Assignee: Oy M. Haloila AB, Masku (FI)

( * ) Notice: Subject to any disclaimer, the term of this patent is extended or adjusted under 35 U.S.C. 154(b) by 52 days.

(21) Appl. No.: 09/783,982

(22) Filed: Feb. 16, 2001

(65) Prior Publication Data

US 2001/0015057 A1 Aug. 23, 2001

(30) Foreign Application Priority Data

Feb. 17, 2000 (FI) ..... 20000361

(51) Int. Cl.
*B65B 53/00* (2006.01)

(52) U.S. Cl. ..... 53/556; 53/588

(58) Field of Classification Search ..... 53/204, 53/556, 587, 588, 589, 389.1, 399, 441; 242/419, 242/419.1

See application file for complete search history.

(56) References Cited

U.S. PATENT DOCUMENTS

| | | | | | |
|---|---|---|---|---|---|
| 1,957,148 | A | * | 5/1934 | Oehmichen | 242/419.1 |
| 3,309,839 | A | * | 3/1967 | Lyon | 53/588 |
| 3,494,095 | A | * | 2/1970 | Valvano | 53/465 |
| 4,302,920 | A | | 6/1984 | Lancaster et al. | |
| 4,458,467 | A | | 7/1984 | Shulman et al. | |
| 4,590,746 | A | | 5/1986 | Humphrey | |
| 4,706,443 | A | * | 11/1987 | Humphrey | 53/556 |
| 4,718,219 | A | * | 1/1988 | Schmitz | 53/556 |
| 5,014,490 | A | * | 5/1991 | Focke et al. | 53/234 |
| 5,125,209 | A | * | 6/1992 | Thimon et al. | 53/399 |
| 5,155,970 | A | * | 10/1992 | Moore | 53/399 |
| 5,235,792 | A | * | 8/1993 | Hanagata | 53/141 |
| 5,311,725 | A | * | 5/1994 | Martin et al. | 53/556 |
| 5,377,926 | A | * | 1/1995 | Min | 242/334.6 |
| 5,768,862 | A | * | 6/1998 | Mauro | 53/556 |
| 5,875,616 | A | * | 3/1999 | Paavola et al. | 425/66 |
| 6,305,145 | B1 | * | 10/2001 | Suolahti | 242/420.6 |

FOREIGN PATENT DOCUMENTS

| | | |
|---|---|---|
| DE | 42 34 604 | 4/1994 |

* cited by examiner

*Primary Examiner*—Scott A. Smith
*Assistant Examiner*—Paul Durand
(74) *Attorney, Agent, or Firm*—Lowe Hauptman & Berner, LLP

(57) ABSTRACT

A wrapping apparatus, in which the supporting elements supporting a film roll are mounted on the frame of a film dispenser with bearings permitting free rotation so that the film roll supported by them is freely rotatable. The pre-stretching rollers are mutually engaged via a transmission and are likewise mounted on the frame with bearings permitting free rotation. A pendulum roller in the film dispenser and the spring force of a spring applying a load on it have been so adapted that the pendulum roller forms between the second pre-stretching roller and the deflecting roller a bend that functions as a film supply containing a varying amount of film, depending on the prevailing draw of the film to keep the drawing velocity and tension of the film substantially constant at the pre-stretching rollers regardless of the variation in the draw and velocity of the film that is caused by the shape of the article being wrapped.

20 Claims, 8 Drawing Sheets

WRAPPING APPARATUS

BACKGROUND OF THE INVENTION

1. Field of the Invention

The present invention relates to a wrapping apparatus. More particularly, the present invention relates to a wrapping apparatus for winding a wrapping film about an article to be wrapped.

2. Description of the Related Art

In prior art, a wrapping apparatus for winding a wrapping film about an article to be packaged is known. The wrapping apparatus comprises a film dispenser arranged to revolve along a circular endless track at a constant velocity about the article to be wrapped. The film dispenser comprises a frame, supporting elements for supporting a film roll on the frame, and a pre-stretching device. The pre-stretching device comprises a first pre-stretching roller rotatably mounted on the frame with bearings at both ends to receive the film from the film roll, and a second pre-stretching roller rotatably mounted on the frame with bearings at both ends and disposed in a position parallel to and at a distance from the first pre-stretching roller. The pre-stretching rollers are coupled together via a regular transmission so that their circumferential velocities differ from each other, the pre-stretching of the film thus occurring within the film portion between the pre-stretching rollers as a result of their different circumferential velocities. The film dispenser further comprises a pendulum roller disposed after the second pre-stretching roller in the direction of film movement to receive the pre-stretched film from the second pre-stretching roller. The pendulum roller is spring-loaded with a spring acting against the drawing direction of the film web. The film dispenser further comprises a deflecting roller mounted by both ends with bearings on the frame, in a position parallel to the pre-stretching rollers and the pendulum roller, the film web coming from the pendulum roller being passed over the deflecting roller to the article to be wrapped.

Typically, the product to be wrapped is a pallet and its cross-section is of a rectangular form. Therefore, the feed rate (i.e. the drawing speed of the film in relation to the film dispenser) at which the film is passed from the film dispenser onto the article varies as the film dispenser is revolving at a constant speed about the article. As the film is stretched between the rollers, the film portion after the pre-stretching rollers is strained to a tension that is proportional to the speed difference between the rollers, to the drawing velocity, to the thickness and width of the film and to the internal elongation properties of the film. As a result of the quadrangular form of the object being wrapped, e.g. a pallet, the drawing velocity of the film varies continuously, producing variation in film tension.

To eliminate the variation of tension, prior-art apparatus use a sensor connected to the pendulum roller to detect the degree of film tension. The film tension detected by the sensor is used as a basis to control the speed of rotation of either the motor driving the film roll, as in European Patent No. EP 0 936 141 A1. the motor driving the posterior pre-stretching roller as seen in the direction of film motion, as in U.S. Pat. No. 5,123,230A, or the drive motor of some other roller used to draw the film from the film roll, as in Patent No. WO 93/24373. These arrangements are designed to eliminate the variation in film tension resulting from the angular shape of the article to be wrapped and to achieve a constant film tension.

The problem with prior-art apparatus is that they are complex and expensive as they need tension detectors and drive motors controlled on the basis of these to drive the rollers and/or the film roll.

SUMMARY OF THE INVENTION

The object of the invention is to eliminate the above-mentioned problems.

A specific object of the invention is to disclose an apparatus having a construction that is simpler, cheaper, more reliable and less susceptible to failure than prior-art devices.

A further object of the invention is to disclose an apparatus in which the drawing velocity and tension of the film can be held substantially constant regardless of the varying draw and drawing velocity of the film caused by the non-circular shape of the article to be wrapped and in which this is achieved using a completely mechanical construction.

According to the invention, the supporting elements are mounted on the frame with bearings permitting free rotation so that the film roll supported by them is freely rotatable. The pre-stretching rollers are mutually coupled and mounted with bearings on the frame so as to be freely rotatable. The pendulum roller and the spring force of the spring are so adapted that the pendulum roller forms between a second pre-stretching roller and a deflecting roller a bend acting as a film supply which contains a varying amount of film, depending on the prevailing draw of the film, to keep the drawing velocity and tension of the film substantially constant at the pre-stretching rollers regardless of the variation in the draw and velocity of the film in relation to the film dispenser that is caused by the shape of the article to be wrapped. The spring is so designed that it tends to keep a predetermined maximum amount of film in the film supply.

When the drawing velocity of the film increases, the film supply delivers film so that the drawing velocity at the pre-stretching rollers remains substantially constant, and when the drawing velocity of the film decreases, the film supply is replenished. The invention makes it possible to maintain a constant film tension throughout the wrapping process. The film tension is not affected by variations in the drawing velocity of the film that are caused by the shape of the product being wrapped; instead, it remains at a predetermined value.

Other preferred embodiments and features of the apparatus are presented in the subclaims below and in the following description of an example referring to the drawings.

BRIEF DESCRIPTION OF THE DRAWINGS

In the following, the invention will be described in detail by the aid of a few examples of its embodiments with reference to the attached drawing, wherein.

DETAILED DESCRIPTION

Figure 1:
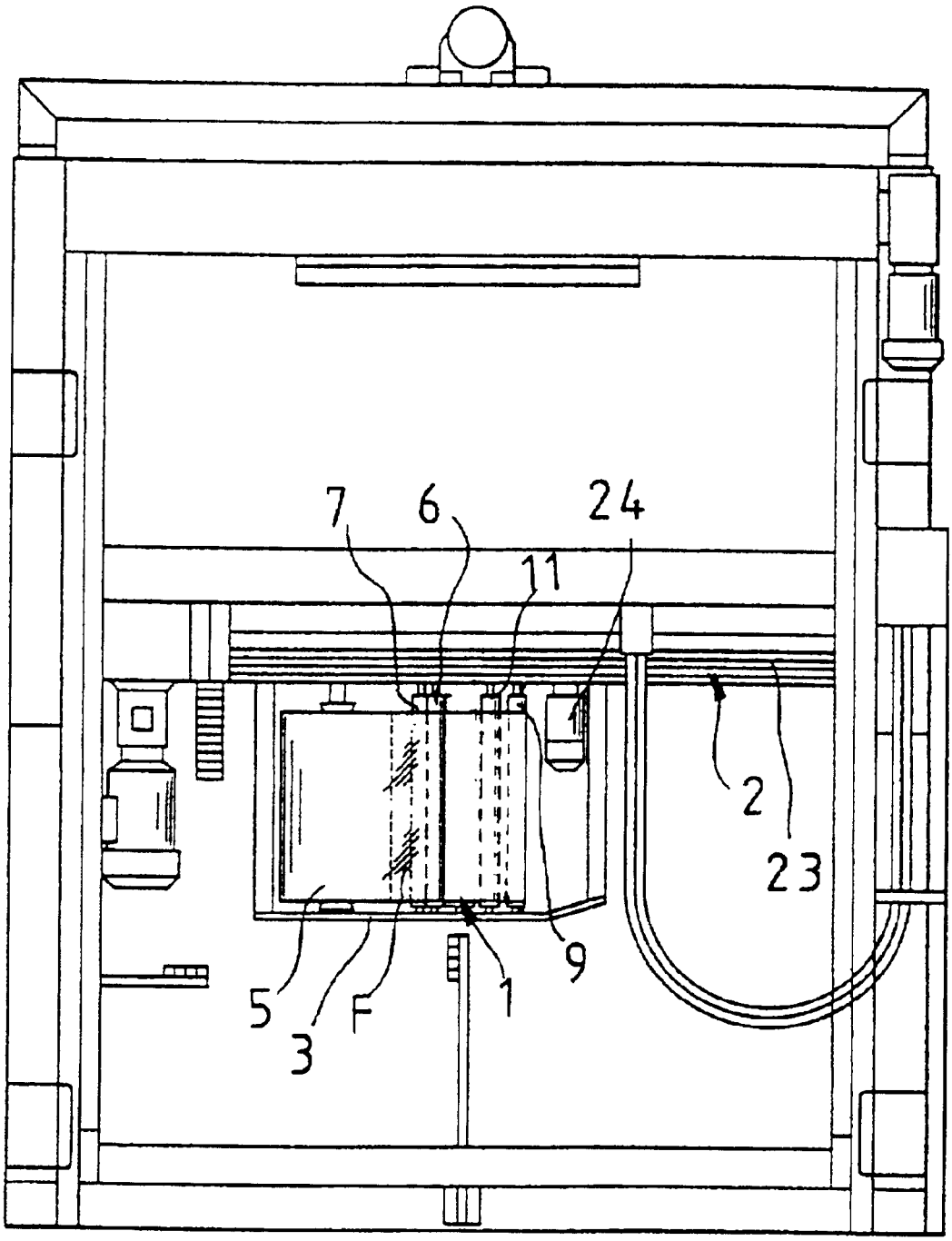
FIG. 1 presents a diagrammatic side view of an embodiment of the wrapping apparatus in accordance with the present invention.
Figure 2:
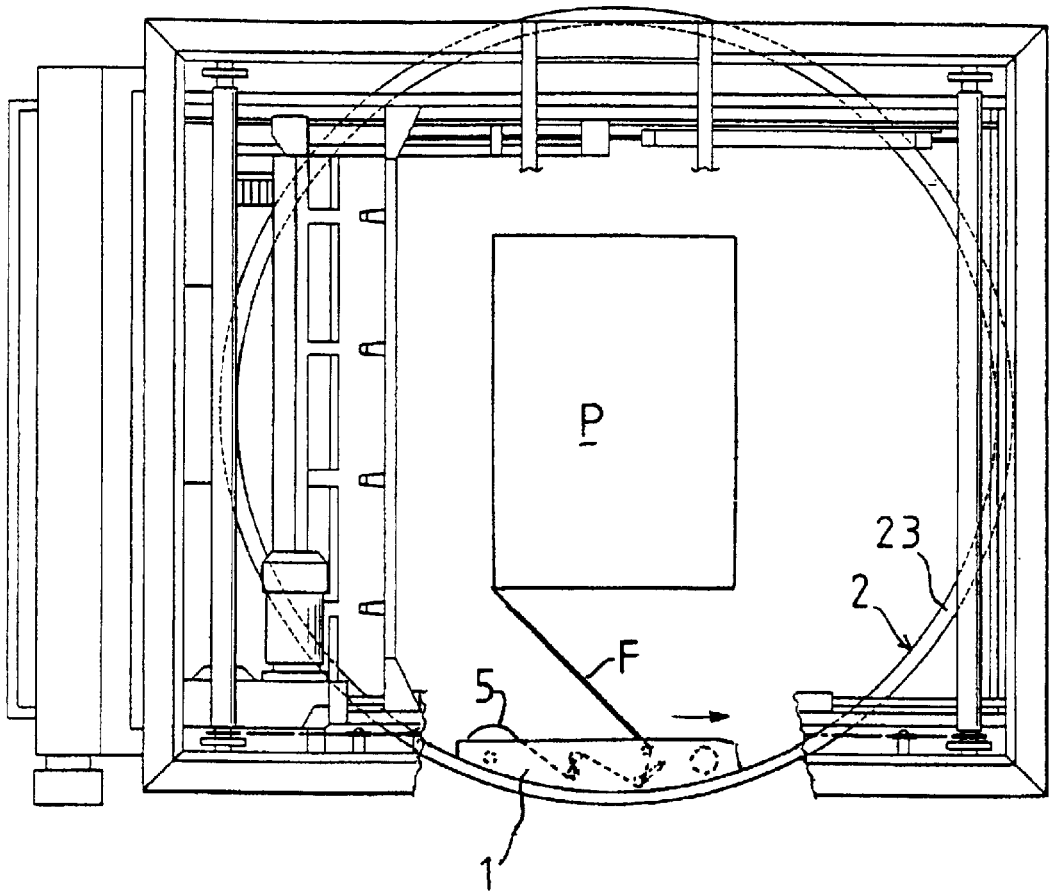
FIG. 2 presents a top view of the wrapping apparatus in FIG. 1.

FIGS. 1 and 2 illustrate a wrapping apparatus designed for winding a wrapping film F about a stationary article to be wrapped. The article may be e.g. a rectangular object P as shown in FIG. 2, such as a pallet.

The wrapping apparatus comprises a film dispenser 1 arranged to circulate at a constant speed along a circular track 2 about an article to be wrapped. The track 2 is implemented as a circular ring guideway 23 which carries the film dispenser 1, the latter being moved by a drive motor 24 provided in the film dispenser. The ring guideway 23 is moved vertically during the wrapping operation so that a spiral wrapping can be formed from the film about the article.

It is to be noted that the film dispenser 1 described here can be applied in any wrapping machine, such as e.g. one in which the film dispenser is connected to a rotary crank that revolves the film dispenser about the object to be wrapped, or in a wrapping machine in which the film dispenser 1 is connected to a fixed column and the film is passed to an object being rotated to form a wrapping about it.

Figure 3:
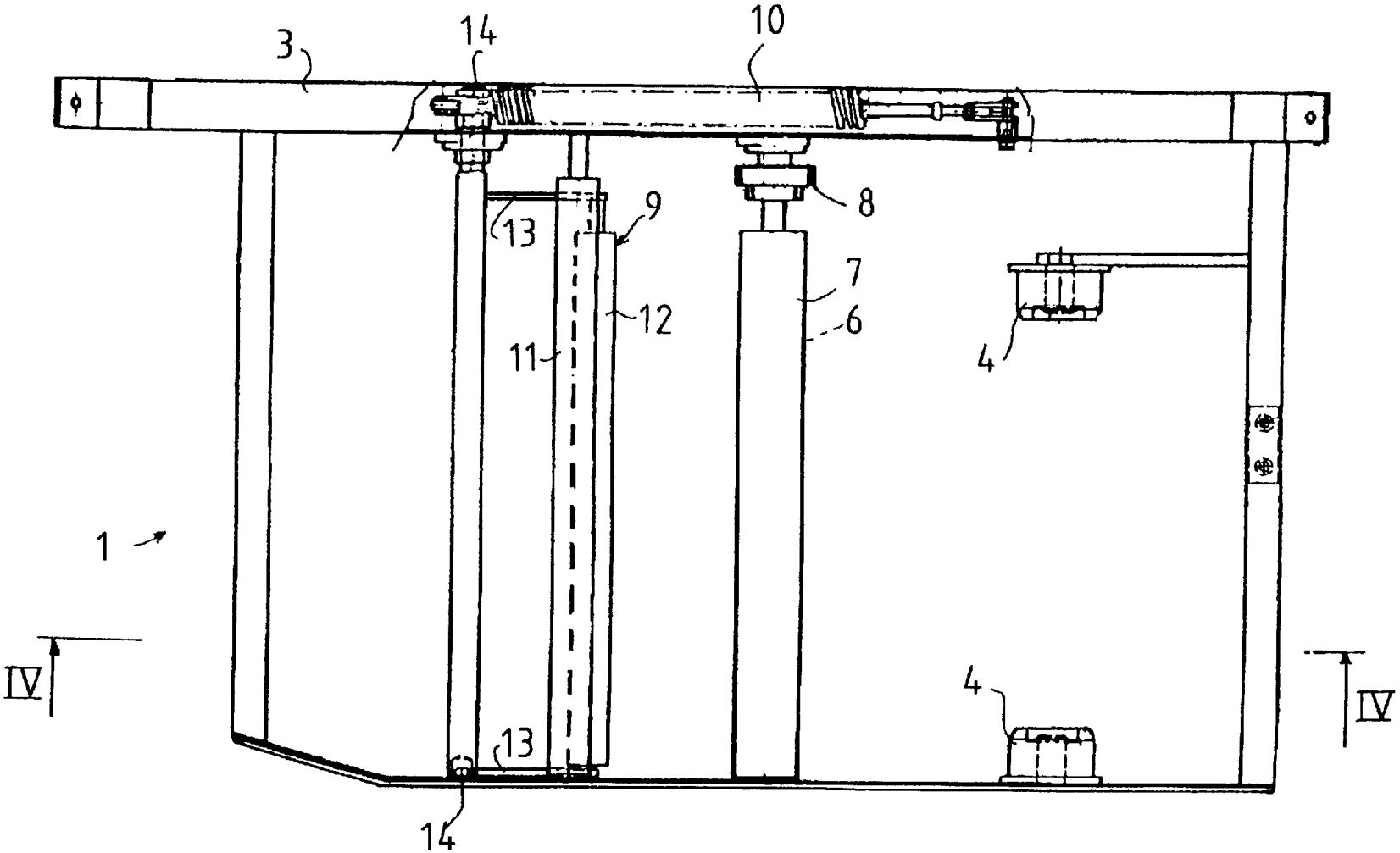
FIG. 3 presents a side view of the film dispenser of the apparatus in FIG. 1.
Figure 4:
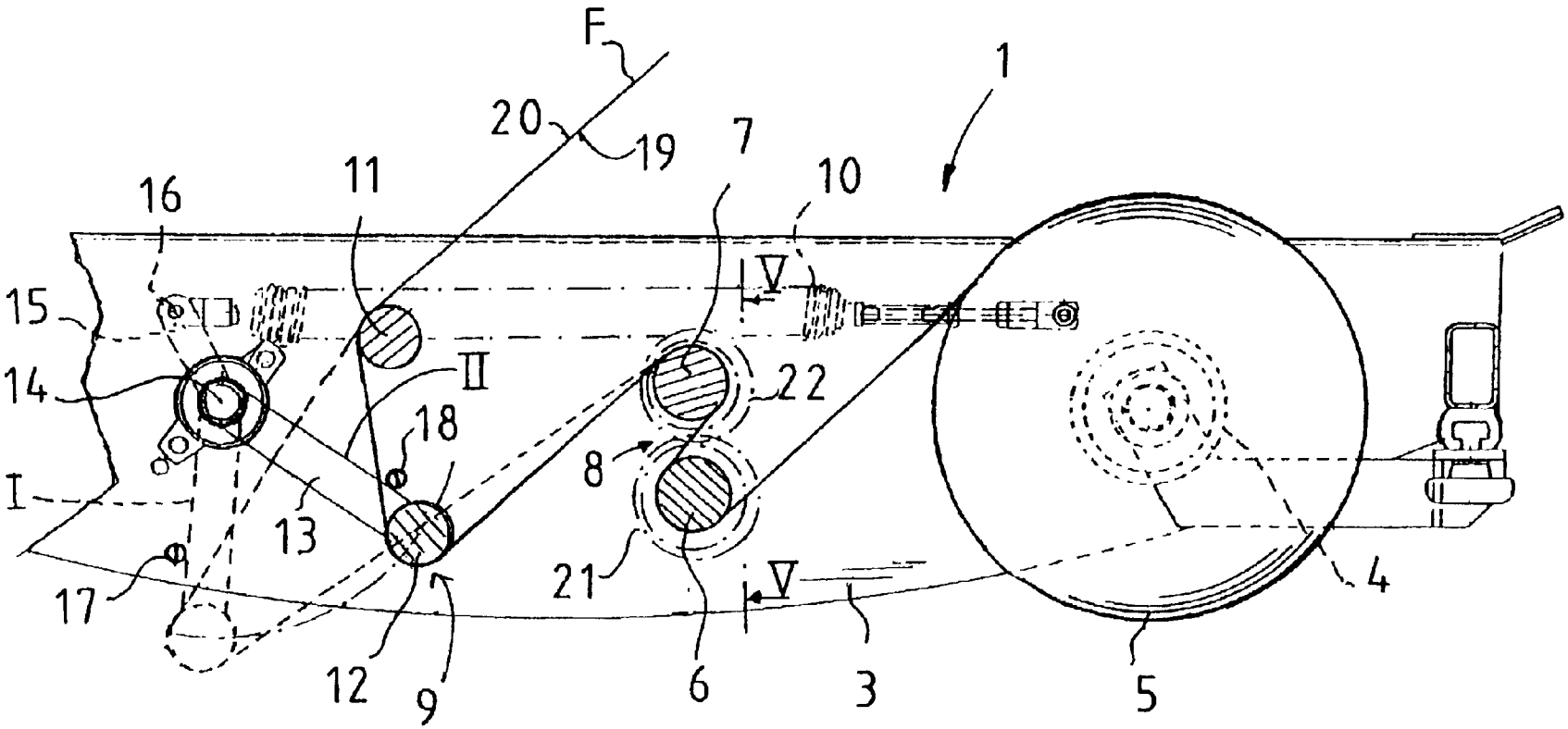
FIG. 4 presents section IV—IV of FIG. 3.

FIGS. 3 and 4 present more detailed views of the film dispenser 1, whose frame 3 is provided with supporting elements 4 for carrying a detachable film roll 5 on the frame. The supporting elements 4 consist of two chucks 4 which can be inserted into the central hole of the film roll from each end of it to support the film roll. The supporting elements 4 are mounted on the frame 3 with bearings allowing free rotation so that the film roll 5 supported by them can rotate freely. In other words, the apparatus comprises no drive means, such as a motor, for rotating the film roll.

Figure 5:
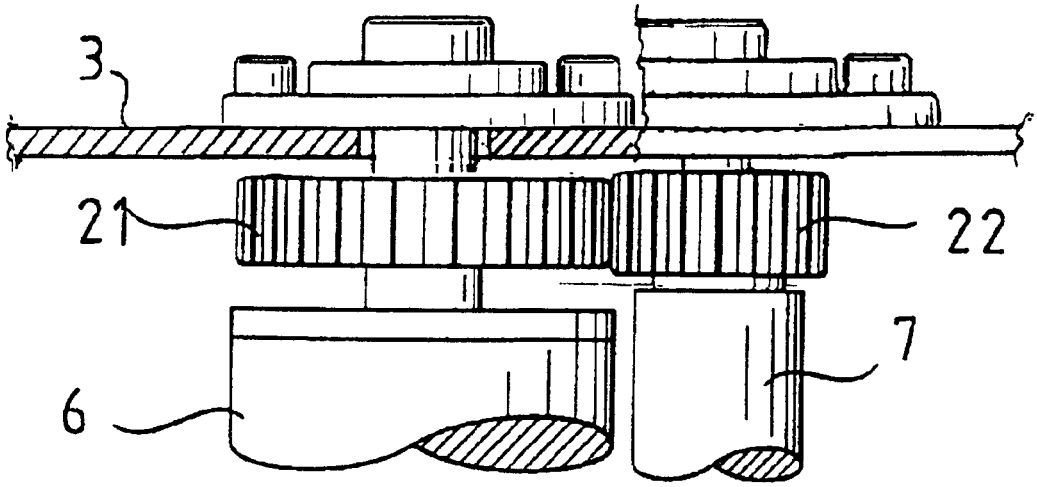
FIG. 5 presents section V—V of FIG. 4.

Further, mounted on the frame 3 is a pre-stretching device 6, 7 comprising a first pre-stretching roller 6, which is rotatably mounted on the frame 3 with bearings at both ends and receives the film from the film roll 5. The pre-stretching device further comprises a second pre-stretching roller 7, which is rotatably mounted on the frame 3 with bearings at both ends, in a position parallel to and at a small distance from the first pre-stretching roller 6. The pre-stretching rollers 6, 7 are supported on the frame by bearings permitting free rotation, i.e. without any drive means, yet so that the pre-stretching rollers are mutually engaged via a regular gear transmission 8. FIG. 5 illustrates a gear transmission in which a first gear 21 is attached to the first pre-stretching roller 6 and a second gear 22 to the second pre-stretching roller 7 and the gears are in direct driving mesh with each other. Thus, the two pre-stretching rollers have different circumferential velocities. To achieve pre-stretching of the film, the transmission ratio of the gear transmission is so selected that the circumferential speed of the second pre-stretching roller 7, which is the posterior one as seen in the direction of film movement, is higher (e.g. about 10% higher) than the circumferential speed of the first pre-stretching roller 6, the pre-stretching of the film thus occurring within the film portion between the pre-stretching rollers as a result of the different circumferential speeds of the pre-stretching rollers.

The film dispenser 1 further comprises a pendulum roller 9, which is disposed after the second pre-stretching roller 7 as seen in the direction of film movement to receive the pre-stretched film from the second pre-stretching roller 7. The pendulum roller 9 is loaded by a spring 10 against the drawing direction of the film F. The pendulum roller 9 comprises a diverting element 12, which is parallel to the pre-stretching rollers 6, 7 and the deflecting roller 11, the film F being passed over the diverting element. The pendulum arms 13 are connected to either end of the diverting element transversely to the longitudinal direction of the diverting element. The turn arbor 14 is fastened to the pendulum arms 13 and mounted with bearings on the frame 3. Attached to the turn arbor 14 is a lever 15. The lever 15 is provided with a fastening element 16 for holding the spring 10. The spring is a helical spring whose one end is connected to the lever 15 while its other end is connected to the frame 3.

The film dispenser further comprises a deflecting roller 11, which is mounted on the frame 3 with bearings at each end, in a position parallel to the pre-stretching rollers 6, 7 and the pendulum roller 9, the film F coming from the pendulum roller 9 being passed over the deflecting roller to the object to be wrapped.

The film F is so threaded over the rollers that the first pre-stretching roller 6, the pendulum roller 9 and the deflecting roller 11 are in contact with the first side 19 of the film F while the second pre-stretching roller 7 is in contact with the second side 20 of the film.

The pendulum roller 9 and the spring force of the spring 10 are so adapted that the pendulum roller 9 creates a bend between the second pre-stretching roller 7 and the deflecting roller 11, said bend acting as a film supply that contains a varying amount of film depending on the prevailing draw of the film F, to keep the drawing velocity and tension of the film substantially constant regardless of the variation in the draw and drawing velocity of the film that is caused by the shape of the article to be wrapped. As a result of the action of the pendulum roller 9, the drawing velocity over the rollers becomes constant, the variation of tension being thus eliminated.

The spring 10 is so designed that it tends to keep the film supply full. When the rate of film consumption increases, the drawing velocity at the rollers is not substantially increased because the film supply first delivers the film it contains. When the rate of consumption falls, the film supply is replenished and the velocity and therefore the film tension at the rollers remain constant. The film supply only starts delivering film when the film feed rate exceeds a certain value, whereupon the film supply begins delivering film and the tension assumes a predetermined level. When the film feed rate exceeds a certain level, the film supply will deliver film because the tension becomes greater than the spring force.

As can be seen from FIG. 4, the apparatus comprises limit elements 17, 18 for limiting the deflection angle of the pendulum roller 9 to a predetermined magnitude; in this embodiment, the maximum deflection angle of the pendulum arm 13 between the extreme positions is 60°. The limit elements 17, 18 comprise a first limit element 17 determining a first extreme position I of the pendulum roller 9, in which the film supply formed by it contains a maximum amount of film, and a second limit element 18 determining a second extreme position II of the pendulum roller 9, in which the film supply formed by it contains a minimum amount of film.

Figure 6:
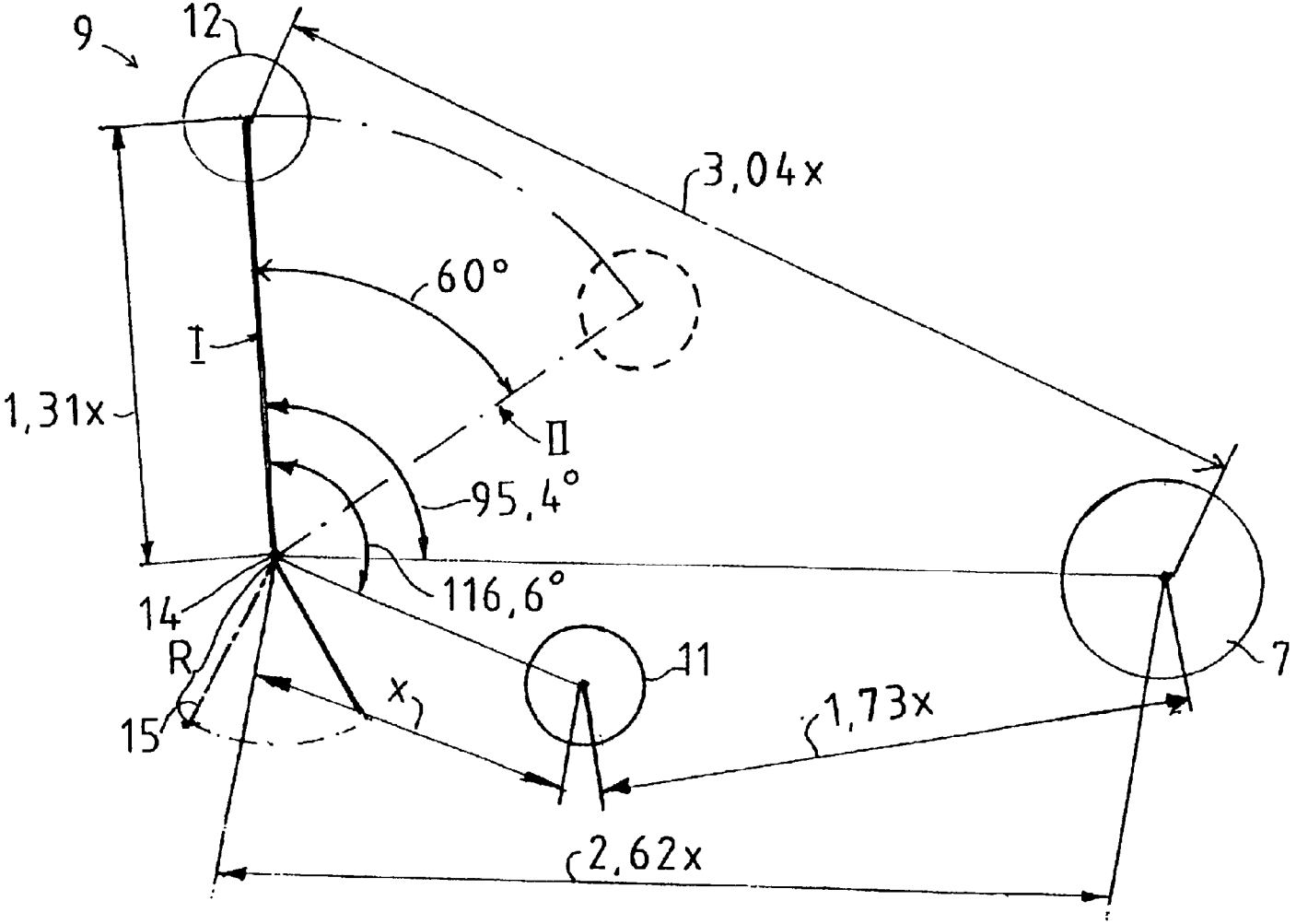
FIG. 6 presents a diagram illustrating the mutual geometric layout of the second pre-stretching roller, deflecting roller and pendulum roller of the film dispenser in FIG. 4.

FIG. 6 presents a preferred geometric layout of the rollers 7, 9 and 11. In designing the layout, it is important that the film supply should contain a sufficient amount of film to eliminate the variation in film tension caused by the drawing velocity of the film, and that the film tension remains substantially the same regardless of the amount of film in the film supply.

The maximum deflection angle of the pendulum arm 13 between the extreme positions I and II is 60°. The distance between the swing axis 14 of the pendulum roller 9 and the center axis of the deflecting roller 11 is designated as x. In that case, the distance between the center axis of the second pre-stretching roller 7 and the diverting element 12 of the pendulum roller 9 is equal to 3.04*x. The distance between the center axis of the diverting element 12 of the pendulum roller 9 and the swing axis 14 of the pendulum roller 9 equals 1.31*x. The distance between the center axis of the deflecting roller 11 and the center axis of the second pre-stretching roller 7 equals 1.73*x. The distance between the swing axis 14 of the pendulum roller 9 and the center axis of the second pre-stretching roller 7 equals 2.62*x.

The angle formed between the first extreme position I of the pendulum roller and the center axis of the second pre-stretching roller 7 with the swing axis 14 of the pendulum roller 9 at the angle vertex equals 95.4°. The angle formed between the first extreme position I of the pendulum roller and the center axis of the deflecting roller 11 with the swing axis 14 of the pendulum roller 9 at the angle vertex equals 116.6°.

In a certain design, the distance x between the swing axis 14 of the pendulum roller 9 and the center axis of the deflecting roller 11 equals 105.4 mm. In this case, the distance between the center axis of the second pre-stretching roller 7 and the center axis of the diverting element 12 of the pendulum roller 9 equals 320.3 mm. The distance between the center axis of the diverting element 12 of the pendulum roller 9 and the swing axis 14 of the pendulum roller 9 equals 137.6 mm. The distance between the center axis of the deflecting roller 11 and the center axis of the second pre-stretching roller 7 equals 182.3 mm. The distance between the swing axis 14 of the pendulum roller 9 and the center axis of the second pre-stretching roller 7 equals 276.5 mm. The length R of the lever 15 (measured from the swing axis 14 of the pendulum roller 9 to the fastening point of the spring 10) equals 60 mm. The spring constant of the spring 10 is 1.4 N/mm.

Figure 7:
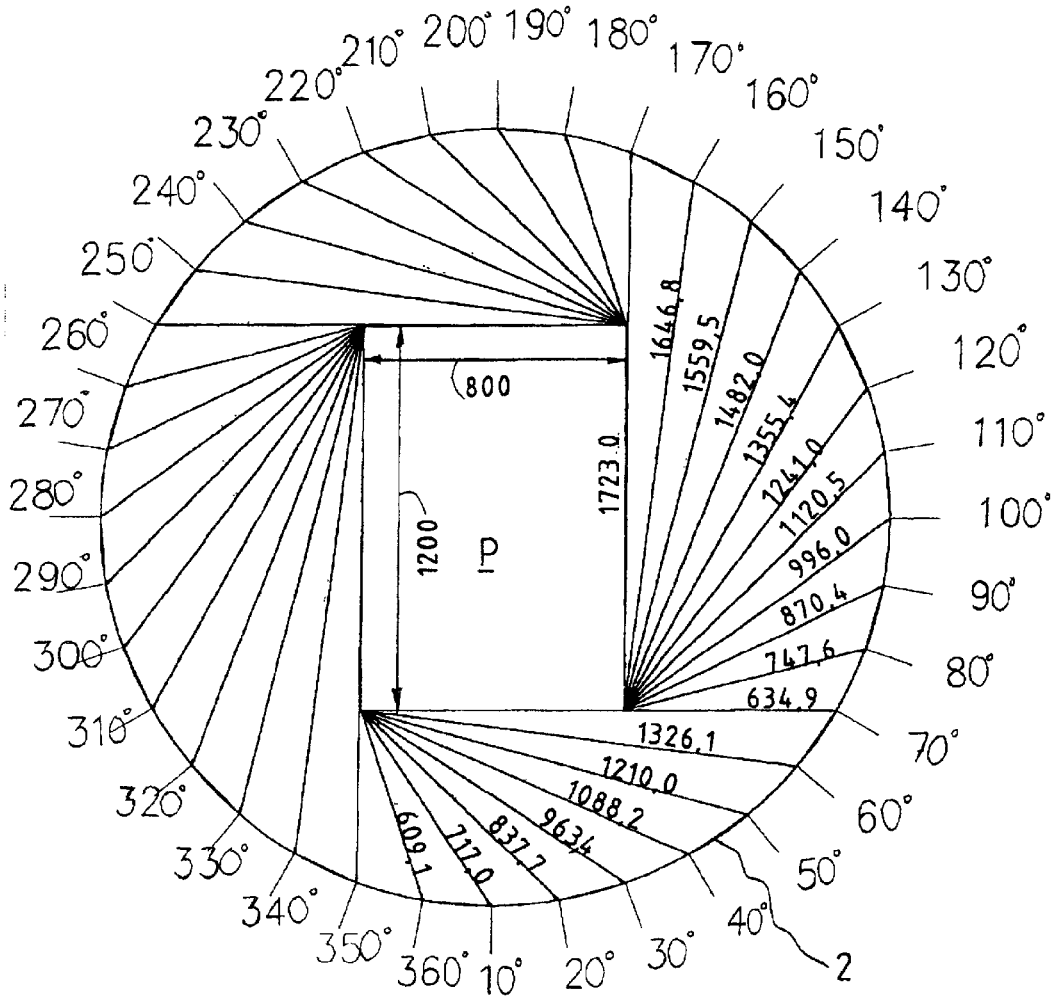
FIG. 7 is associated with the computational example in FIG. 8 and presents a diagrammatic view of a product P to be wrapped, said product having a rectangular cross-section and being placed inside a circular wrapping track, the track being divided into sections at ten-degree intervals while the length of the film span from a corner of the package to the deflecting roller has been calculated and depicted in the figure for each number of degrees indicated.

FIG. 7 represents the circular track 2 of the film dispenser and a rectangular package P to be wrapped placed inside it, the dimensions of the package corresponding to a standard pallet measuring 800 mm×1200 mm. The track circle 2 has been divided into sections at 10-degree intervals and the length of the film span has been calculated for each section. Based on the length of the film span, it is possible to calculate the instantaneous film tension for each point in FIG. 7, the film properties, film dispenser speed and the film track design according to FIG. 6 in the film dispenser being known.

Figure 8:
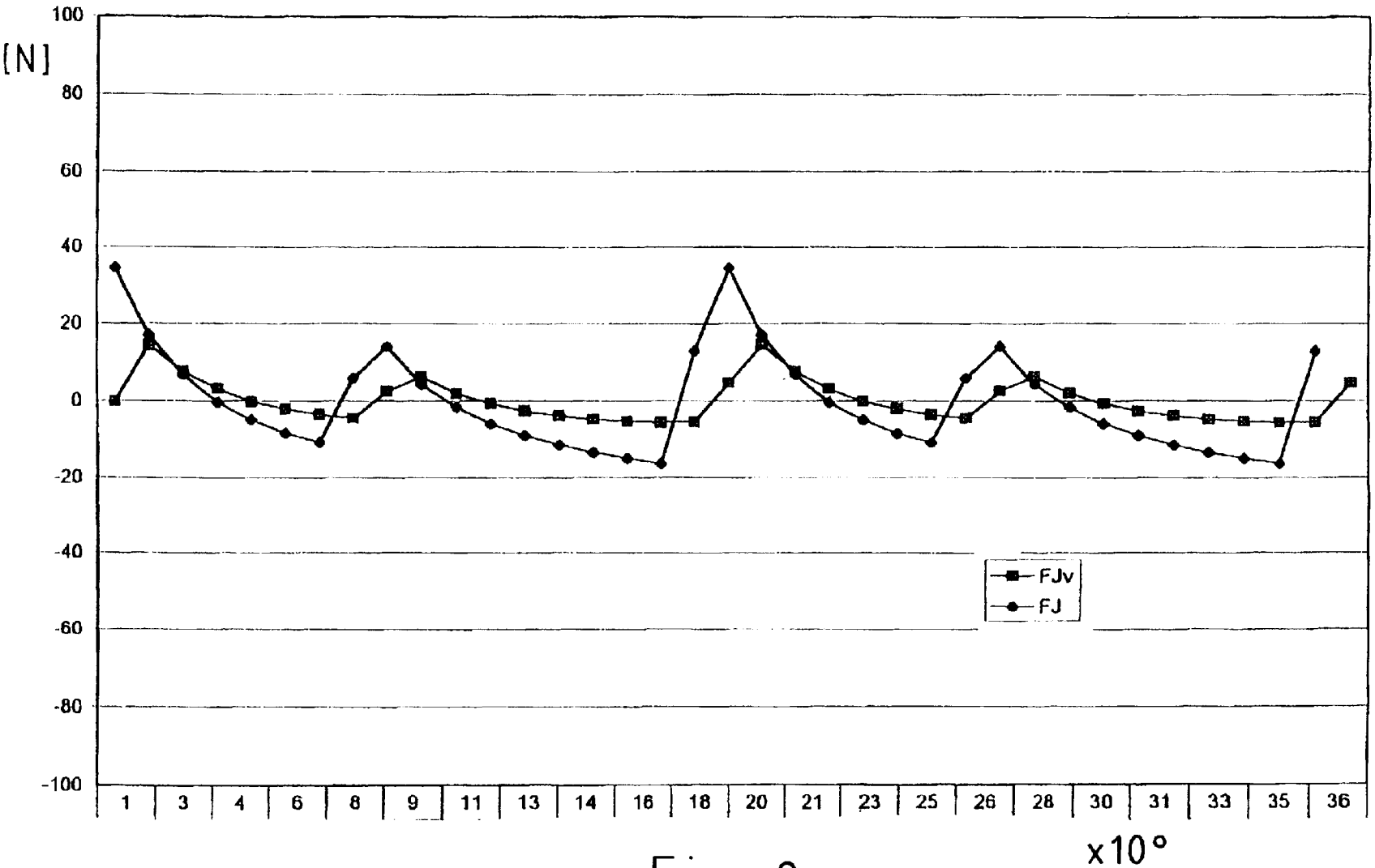
FIG. 8 illustrates the film tension (vertical axis) for different values of the wrapping circle angle (horizontal axis) indicated in FIG. 7, with fraction line (FJ) representing film tension when no pendulum roller is used and fraction line (FJv) representing film tension when a pendulum roller is used.

FIG. 8 presents a curve representing the film tension in units N at different points along the track, calculated on the basis of the above-mentioned starting values. Fraction line FJ represents film tension when no pendulum roller is used. Fraction line FJv represents film tension when a pendulum roller 9 is used. FIG. 8 shows clearly that the variation in film tension is considerably smaller when a pendulum roller is used, as compared with a situation where no pendulum roller is used.

The invention is not restricted to the examples of its embodiments described above; instead, many variations are possible within the scope of the inventive idea defined in the claims.

What is claimed is:

1. A wrapping apparatus for winding a wrapping film about an article to be wrapped, said wrapping apparatus including a film dispenser arranged to revolve along a circular track at a substantially constant velocity about the article to be wrapped, said film dispenser comprising:

a frame;

supporting elements adapted to support a film roll on said frame, said film roll being freely rotatable;

a film pre-stretcher comprising a first pre-stretching roller freely rotatably mounted on said frame to receive film from said film roll and a second pre-stretching roller freely rotatably mounted on said frame and disposed in a position parallel to and at a distance from said first pre-stretching roller, said first and second pre-stretching rollers being coupled together to have different circumferential velocities such that a portion of said film located between said first and second pre-stretching rollers is pre-stretched;

a freely rotatable pendulum roller and a spring, said pendulum roller being disposed after said second pre-stretching roller in a direction of film movement to receive said pre-stretched film from said second pre-stretching roller, and said pendulum roller being spring-loaded by said spring acting against a drawing direction of said film; and a deflecting roller freely rotatably mounted on said frame in a position parallel to said first and second pre-stretching rollers and said pendulum roller, said film coming from said pendulum roller and passing over said deflecting roller to the article being wrapped;

wherein said pendulum roller and said spring are adapted so that a bend is formed between said pendulum roller and said second pre-stretching roller, said deflecting roller acting as a film supply to contain a varying amount of film, depending on a prevailing draw of said film, to maintain a substantially constant drawing velocity and tension of said film from said second pre-stretching roller regardless of variations in said draw and velocity of said film in relation to said film dispenser, said variations in said draw and velocity of said film being caused by a shape of the article being wrapped; and wherein said spring pendulum roller, said second pre-stretching roller and said deflecting roller are arranged to maintain a substantially constant film tension regardless of a position of said pendulum roller.

2. The apparatus as defined in claim 1, wherein said pendulum roller comprises:

a diverter disposed parallel to said first and second pre-stretching rollers and said deflecting roller, said film passing over said diverter;

a pair of pendulum arms respectively connected to each end of said diverter, said pair of pendulum arms being arranged transversely to a longitudinal direction of said diverter;

a turn arbor coupled to said pair of pendulum arms and pivoted on said frame, and a lever coupled to said turn arbor and having a fastener to fasten said spring thereto.

3. The apparatus as defined in claim 2, wherein said spring comprises a helical spring having a first end connected to said lever and a second end connected to said frame.

4. The apparatus as defined in claim 2, wherein a maximum deflection angle of said pendulum arms between their extreme positions is 60°; and wherein, upon a distance between a swing axis of said pendulum roller and a center axis of said deflecting roller being equal to x;

a distance between a center axis of said second pre-stretching roller and a center axis of said diverter of said pendulum roller is equal to 3.04x;

a distance between said center axis of said diverter of said pendulum roller and a swing axis of said pendulum roller is equal to 1.31x;

a distance between said center axis of said diverter and said center axis of said second pre-stretching roller is equal to 1.73x; and a distance between said swing axis of said pendulum roller and said center axis of said second pre-stretching roller is equal to 2.62x.

5. The apparatus as defined in claim 4, wherein said distance x between said swing axis of said pendulum roller and said center axis of said diverter is equal to 105.4 mm.

6. The apparatus as defined in claim 1, said apparatus further comprising limit stoppers to limit a deflection angle of said pendulum roller to a pre-determined magnitude.

7. The apparatus as defined in claim 6, wherein said limit stoppers comprise a first limit stopper, to determine a first extreme position of said pendulum roller, in which said film supply formed by it contains a maximum amount of film, and a second limit stopper, to determine a second extreme position of said pendulum roller, in which said film supply formed by it contains a minimum amount of film.

8. The apparatus as defined in claim 1, wherein said first pre-stretching roller, said pendulum roller and said deflecting roller are arranged to contact a first side of said film while said second pre-stretching roller is arranged to contact a second side of said film.

9. The apparatus as defined in claim 1, further comprising a gear transmission coupled between said first and second pre-stretching rollers, said gear transmission having a first gear coupled to said first pre-stretching roller and a second gear coupled to said second pre-stretching roller.

10. The apparatus as defined in claim 9, wherein a transmission ratio of said gear transmission is of the order of 90%.

11. A wrapping apparatus for winding a wrapping film about an article to be wrapped, said wrapping apparatus including a film dispenser which comprises:

a frame;

a film roll supported on said frame, said film roll being freely rotatable;

a film pre-stretcher comprising a first pre-stretching roller freely rotatably mounted on said frame to receive film from said film roll and a second pre-stretching roller freely rotatably mounted on said frame and disposed in parallel to and at a distance from said first pre-stretching roller, said first and second pre-stretching rollers being coupled together to have different circumferential velocities such that a portion of said film located between said first and second pre-stretching rollers is pre-stretched;

a freely rotatable pendulum roller and a spring, said pendulum roller being disposed after said second pre-stretching roller in a direction of film movement to receive said pre-stretched film from said second pre-stretching roller, and said pendulum roller being spring-loaded by said spring acting against a drawing direction of said film; and a deflecting roller freely rotatably mounted on said frame in parallel to said first and second pre-stretching rollers and said pendulum roller, said film coming from said pendulum roller and passing over said deflecting roller to the article being wrapped;

wherein said pendulum roller creates a bend of said film between said deflecting roller and said second pre-stretching roller, said bend acting as a film supply to contain a varying amount of said film, depending on a prevailing draw of said film, to maintain a substantially constant drawing velocity and tension of said film from said second pre-stretching roller regardless of variations in said draw and velocity of said film in relation to said film dispenser, said variations in said draw and velocity of said film being caused by a shape of the article being wrapped.

12. The apparatus as defined in claim 11, wherein said pendulum roller comprises:

a diverter disposed parallel to said first and second pre-stretching rollers and said deflecting roller, said film passing over said diverter;

a pair of pendulum arms respectively connected to each end of said diverter, said pair of pendulum arms being arranged transversely to a longitudinal direction of said diverter; and a turn arbor coupled to said pair of pendulum arms and pivoted on said frame, and a lever coupled to said turn arbor and having a fastener to fasten said spring thereto, wherein said spring comprises a helical spring having a first end connected to said lever and a second end connected to said frame.

13. The apparatus as defined in claim 11, said apparatus further comprising limit stoppers to limit a deflection angle of said pendulum roller to a pre-determined magnitude.

14. The apparatus as defined in claim 13, wherein said limit stoppers comprise a first limit stopper, to determine a first extreme position of said pendulum roller, in which said film supply formed by it contains a maximum amount of film, and a second limit stopper, to determine a second extreme position of said pendulum roller, in which said film supply formed by it contains a minimum amount of film.

15. The apparatus as defined in claim 13, wherein a maximum deflection angle of said pendulum arms between their extreme positions is 60°; and wherein, upon a distance between a swing axis of said pendulum roller and a center axis of said deflecting roller being equal to x;

a distance between a center axis of said second pre-stretching roller and a center axis of said diverter of said pendulum roller is equal to 3.04x;

a distance between said center axis of said diverter of said pendulum roller and a swing axis of said pendulum roller is equal to 1.31x;

a distance between said center axis of said diverter and said center axis of said second pre-stretching roller is equal to 1.73x; and a distance between said swing axis of said pendulum roller and said center axis of said second pre-stretching roller is equal to 2.62x.

16. The apparatus as defined in claim 15, wherein said distance x between said swing axis of said pendulum roller and said center axis of said diverter is equal to 105.4 mm.

17. The apparatus as defined in claim 11, wherein said pendulum roller, said second pre-stretching roller and said deflecting roller are arranged to maintain a substantially constant film tension regardless of a position of said pendulum roller.

18. The apparatus as defined in claim 11, wherein said spring is a helical spring which has a varying spring force depending on an amount of deformation of said spring.

19. A film dispenser for use in a wrapping apparatus for winding a wrapping film about an article to be wrapped, said film dispenser comprising:

a frame;

a film roll supported on said frame, said film roll being freely rotatable;

a first pre-stretching roller rotatably mounted on said frame to receive film from said film roll and a second pre-stretching roller rotatably mounted on said frame and disposed in parallel to and at a distance from said first pre-stretching roller, said first and second pre-stretching rollers being coupled together to have different circumferential velocities such that a portion of said film located between said first and second pre-stretching rollers is pre-stretched;

a freely rotatable pendulum roller and a spring, said pendulum roller being disposed after said second pre-stretching roller in a direction of film movement to receive said pre-stretched film from said second pre-stretching roller, and said pendulum roller being spring-loaded by said spring acting against a drawing direction of said film; and a deflecting roller freely rotatably mounted on said frame in parallel to said first and second pre-stretching rollers and said pendulum roller, said film coming from said pendulum roller and passing over said deflecting roller to the article being wrapped;

wherein said pendulum roller creates a bend of said film between said deflecting roller and said second pre-stretching roller, said bend acting as a film supply to contain a varying amount of said film, depending on a prevailing draw of said film, to maintain a substantially constant drawing velocity and tension of said film from said second pre-stretching roller regardless of variations in said draw and velocity of said film in relation to said film dispenser, said variations in said draw and velocity of said film being caused by a shape of the article being wrapped; and all of said first and second pre-stretching rollers and said deflecting roller are idler rollers, and rotational movements of said idler rollers are solely caused by said draw of said film.

20. The film dispenser of claim 19, consisting of said frame, said film roll, said first and second pre-stretching rollers, said pendulum roller and said deflecting roller.

* * * * *